US007067010B2

(12) United States Patent
Biddle

(10) Patent No.: US 7,067,010 B2
(45) Date of Patent: Jun. 27, 2006

(54) INDEXING SPRAY MACHINE

(76) Inventor: Harold A. Biddle, 3315 W. Township Rd. 158, Tiffin, OH (US) 44883

( * ) Notice: Subject to any disclaimer, the term of this patent is extended or adjusted under 35 U.S.C. 154(b) by 0 days.

(21) Appl. No.: 10/117,392

(22) Filed: Apr. 5, 2002

(65) Prior Publication Data

US 2003/0188684 A1 Oct. 9, 2003

(51) Int. Cl.
*B05B 15/04* (2006.01)
*B05B 15/12* (2006.01)

(52) U.S. Cl. ..... 118/326; 118/321; 118/66; 118/69; 118/704

(58) Field of Classification Search ..... 118/313–326, 118/704, 697, 61, 64, 66, 67, 696, 69; 427/314, 427/374.1, 378; 34/448, 514
See application file for complete search history.

(56) References Cited

U.S. PATENT DOCUMENTS

| | | | | | |
|---|---|---|---|---|---|
| 3,421,924 | A | * | 1/1969 | Harlam et al. | 427/240 |
| 3,899,994 | A | | 8/1975 | Cook et al. | 118/6 |
| 4,098,932 | A | | 7/1978 | Frische | 427/374 |
| 4,155,327 | A | * | 5/1979 | Alexander et al. | 118/620 |
| 4,485,761 | A | | 12/1984 | Stewart | 118/702 |
| 4,543,909 | A | * | 10/1985 | Sharpless | 118/326 |
| 4,567,818 | A | | 2/1986 | Napadow | 98/115.2 |
| 4,614,300 | A | * | 9/1986 | Falcoff | 239/71 |
| 4,729,907 | A | * | 3/1988 | Deal et al. | 427/64 |
| 4,764,402 | A | * | 8/1988 | Pagendarm et al. | 427/355 |
| 4,765,270 | A | | 8/1988 | Faber | 118/102 |
| 4,770,200 | A | * | 9/1988 | Nesler et al. | 137/84 |
| 5,023,116 | A | * | 6/1991 | Williams et al. | 427/424 |
| 5,370,745 | A | | 12/1994 | Litteral | 118/669 |
| 5,514,214 | A | * | 5/1996 | Joel et al. | 118/52 |
| 5,937,223 | A | * | 8/1999 | Akimoto et al. | 396/604 |
| 6,159,294 | A | * | 12/2000 | Kuster et al. | 118/642 |
| 6,231,932 | B1 | * | 5/2001 | Emch | 427/542 |
| 6,544,337 | B1 | * | 4/2003 | Skrabski et al. | 118/323 |

* cited by examiner

*Primary Examiner*—Chris Fiorilla
*Assistant Examiner*—Yewebdar Tadese
(74) *Attorney, Agent, or Firm*—Jerry Semer

(57) ABSTRACT

The machine is an index spraying machine. The machine has five different stations. The first station is the load/unload station. At this station, work pieces are unloaded after they have been sprayed and new work pieces to be sprayed are loaded on. New pieces then move into the pre-heat station tunnel. A third station is the spraying area. In this area, the work pieces are sprayed. After being sprayed, the work pieces move in the area where they are heated to flash off the volatile fumes. Then they move to the fifth work station where they are cooled and finally they move back into the load/unload station. The spraying area in this machine is sealed to meet NEMA 7 standards. The air capture system cascades the air, thus lowering the air volume that passes through the thermal oxidizer.

13 Claims, 13 Drawing Sheets

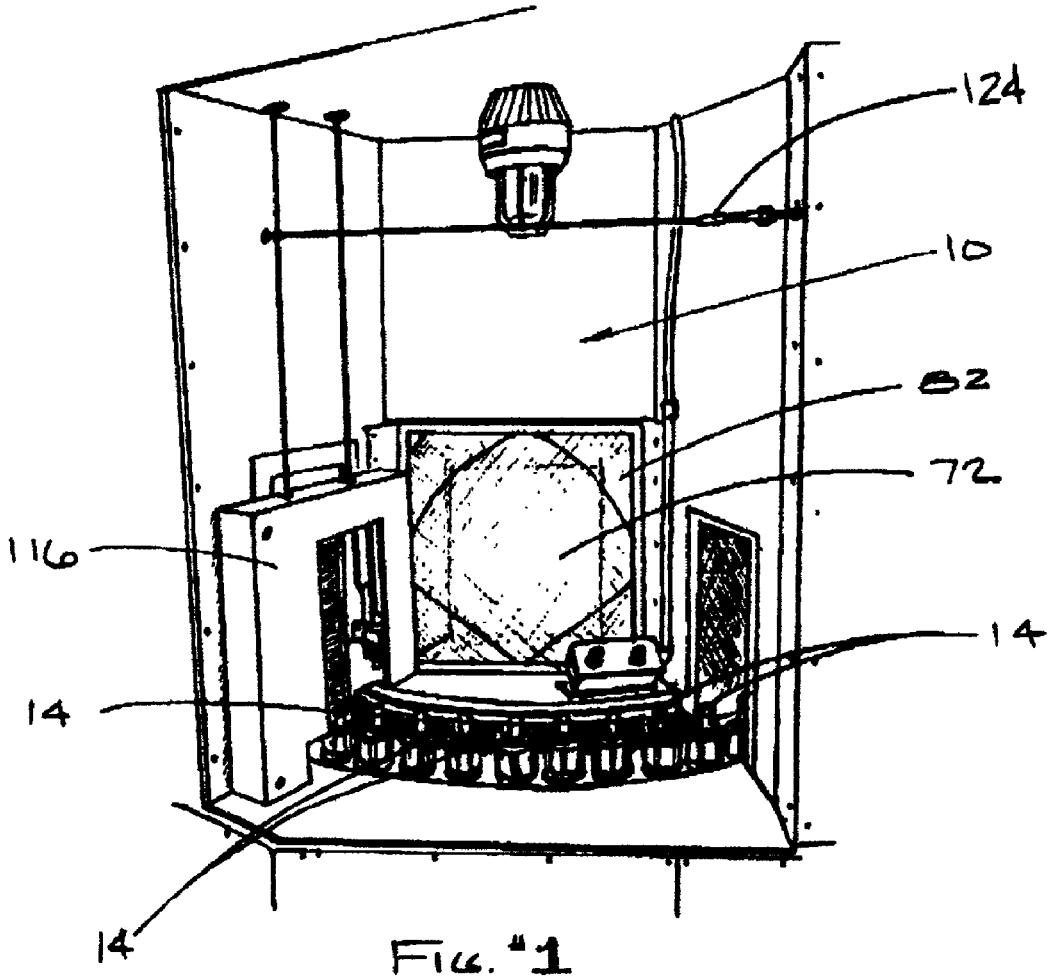
FIG. #1

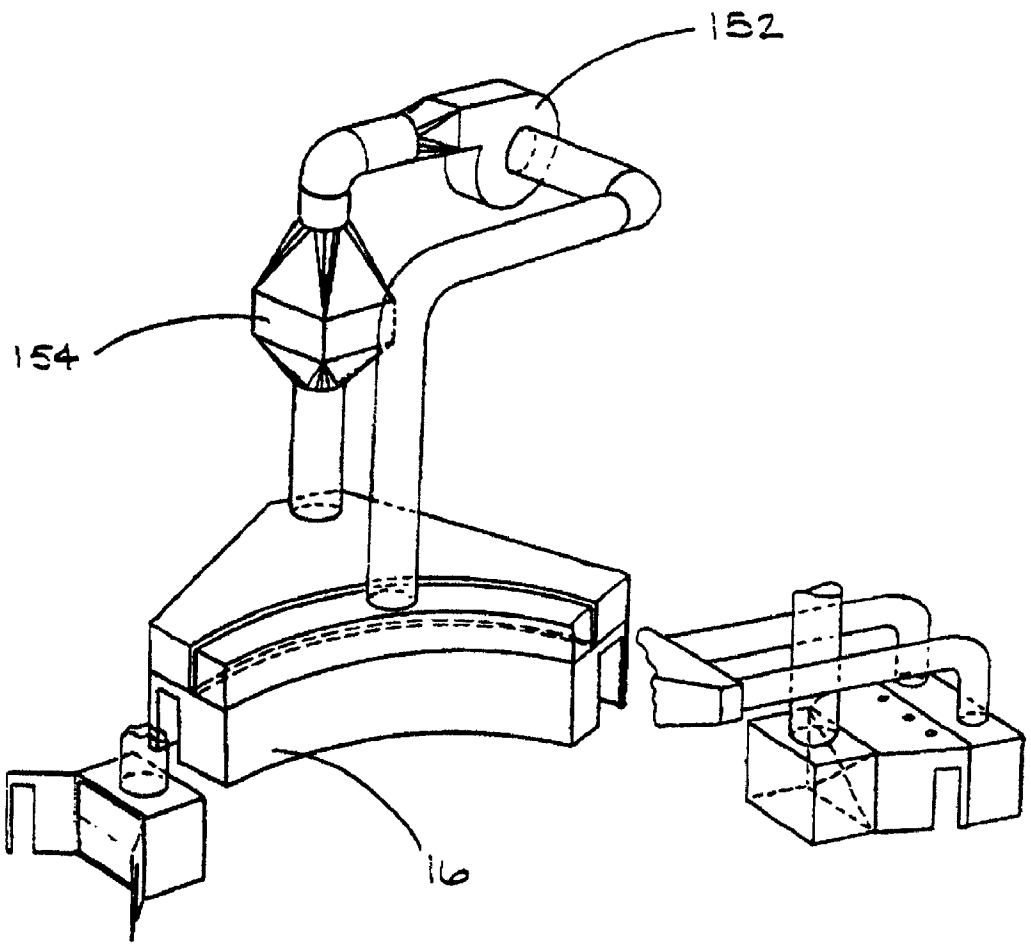
Fig #2

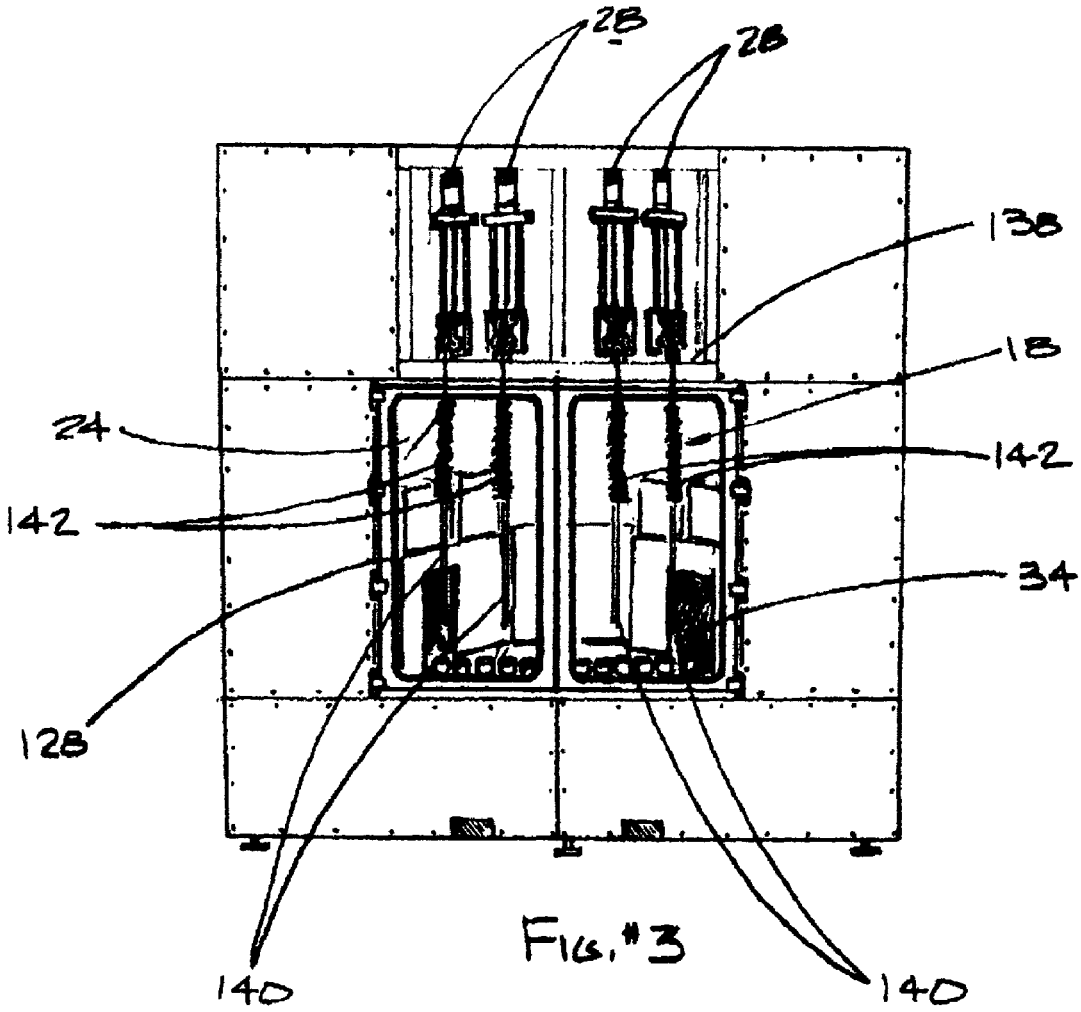
FIG. #3

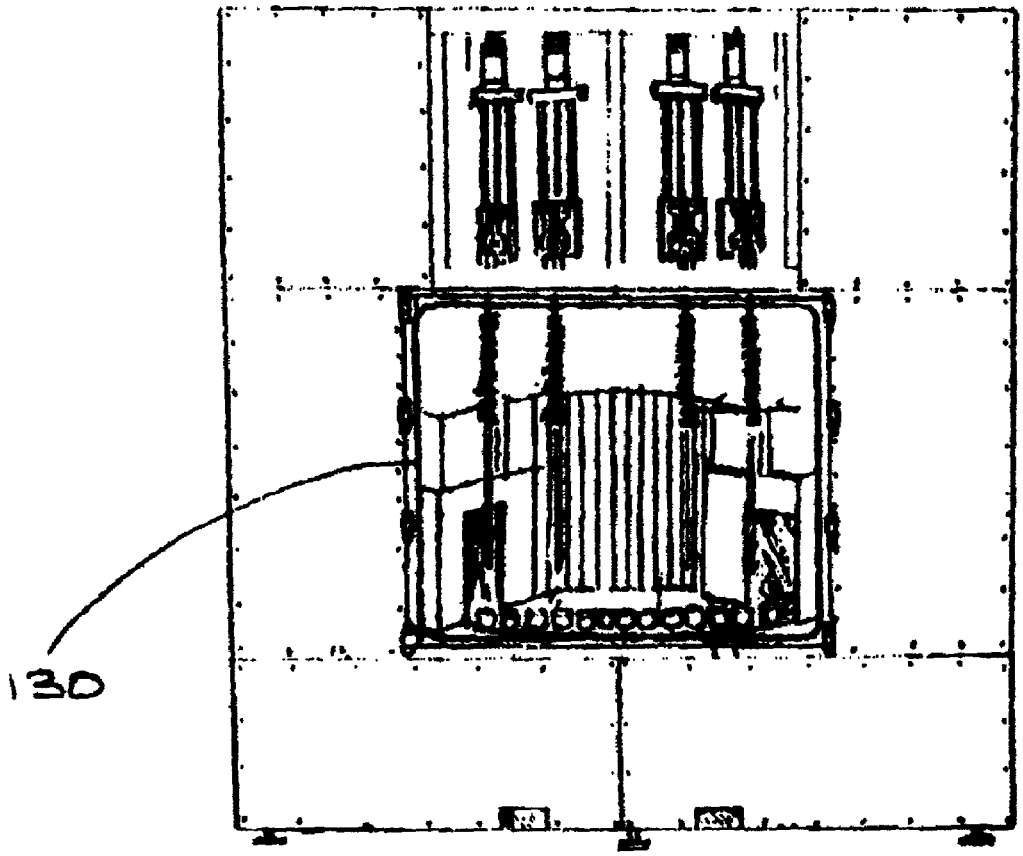
Fig # 3A

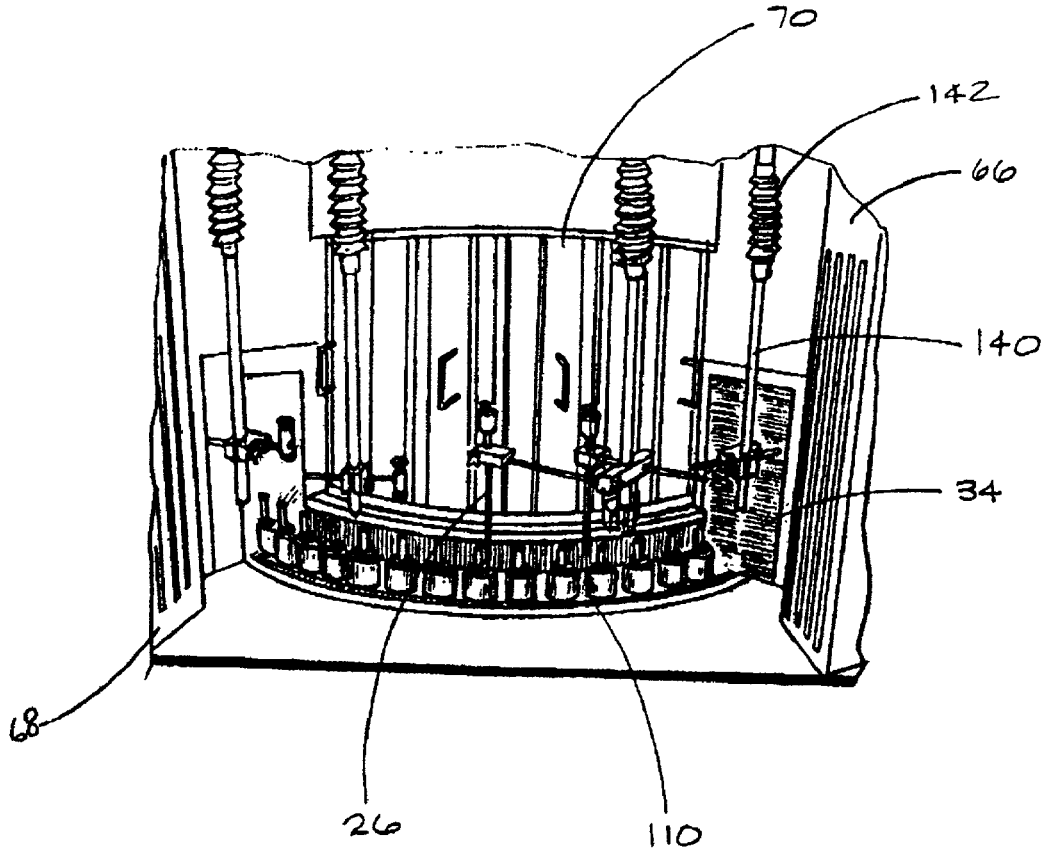
Fig #4

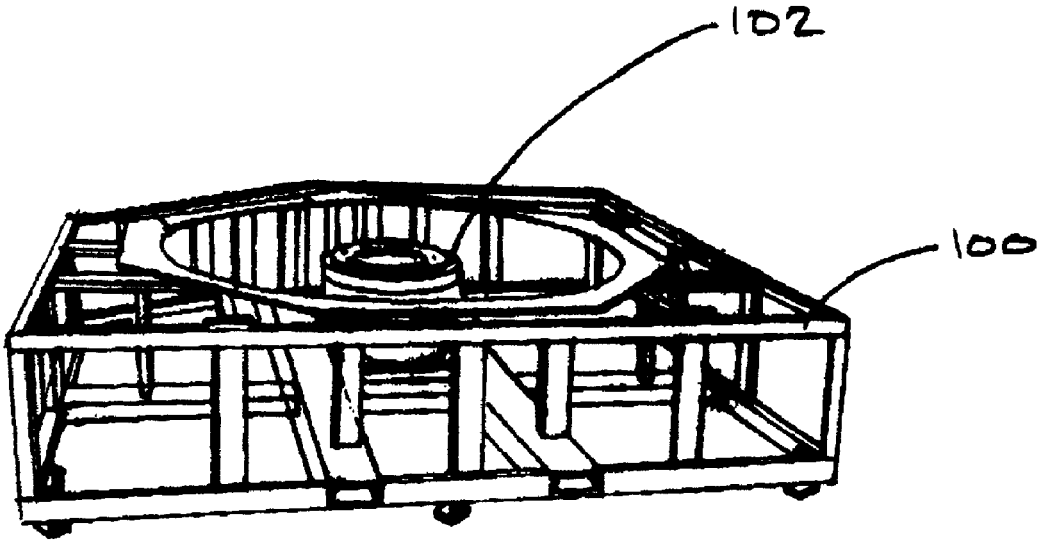
FIG. #5

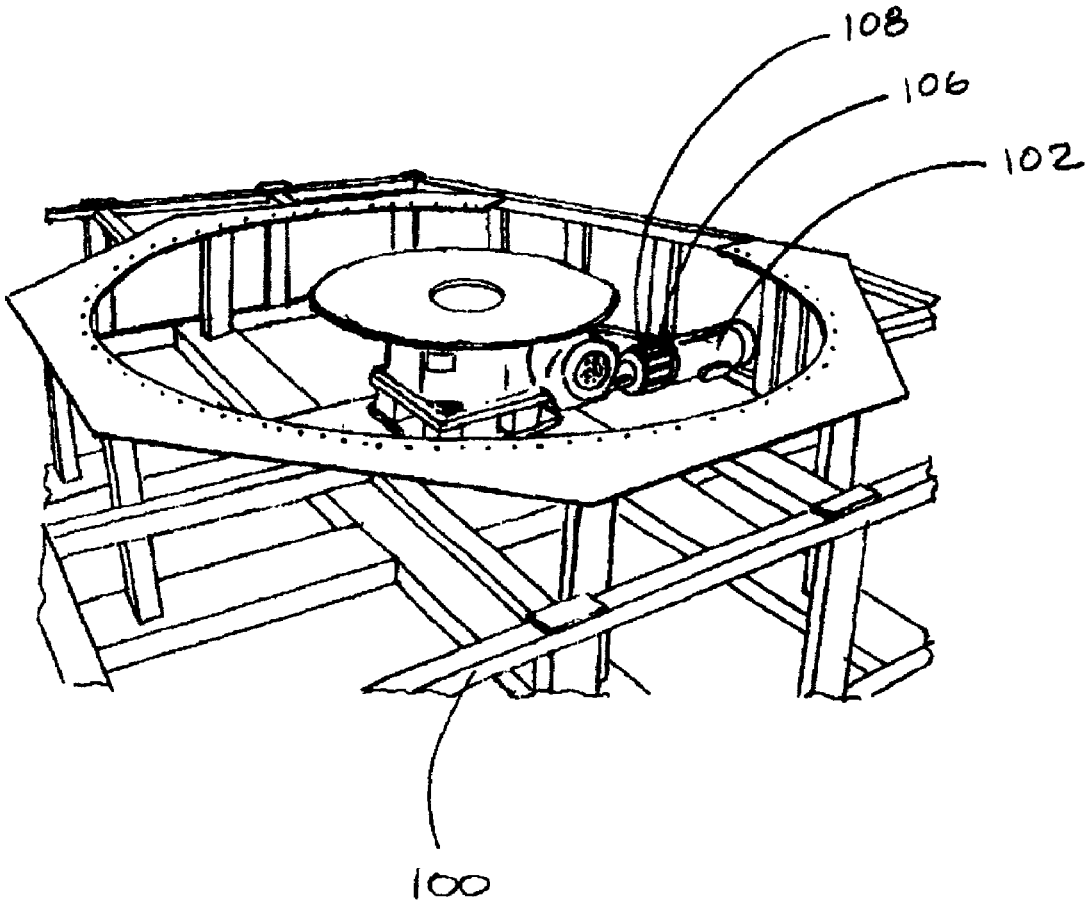
Fig # 5A

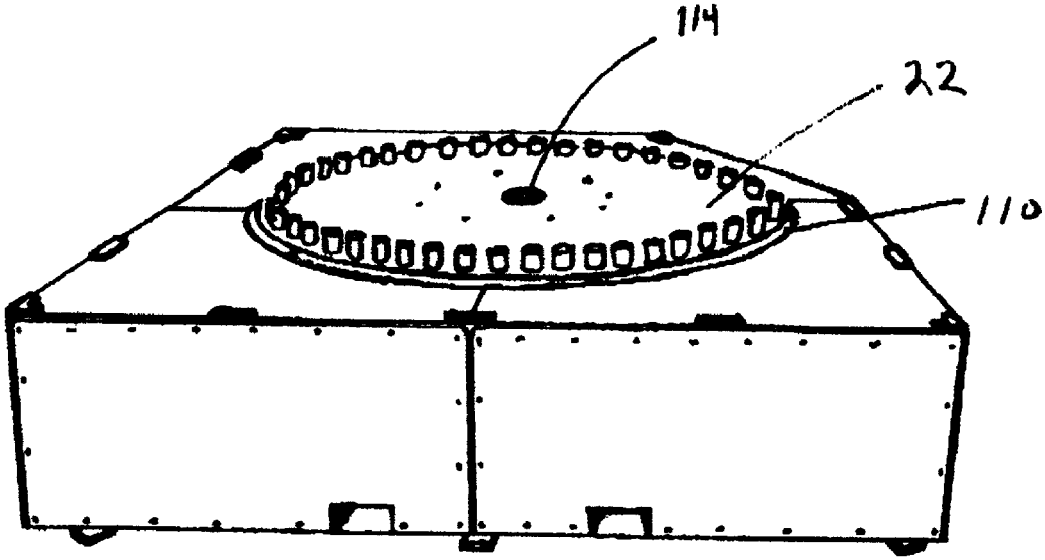
FIG. #6

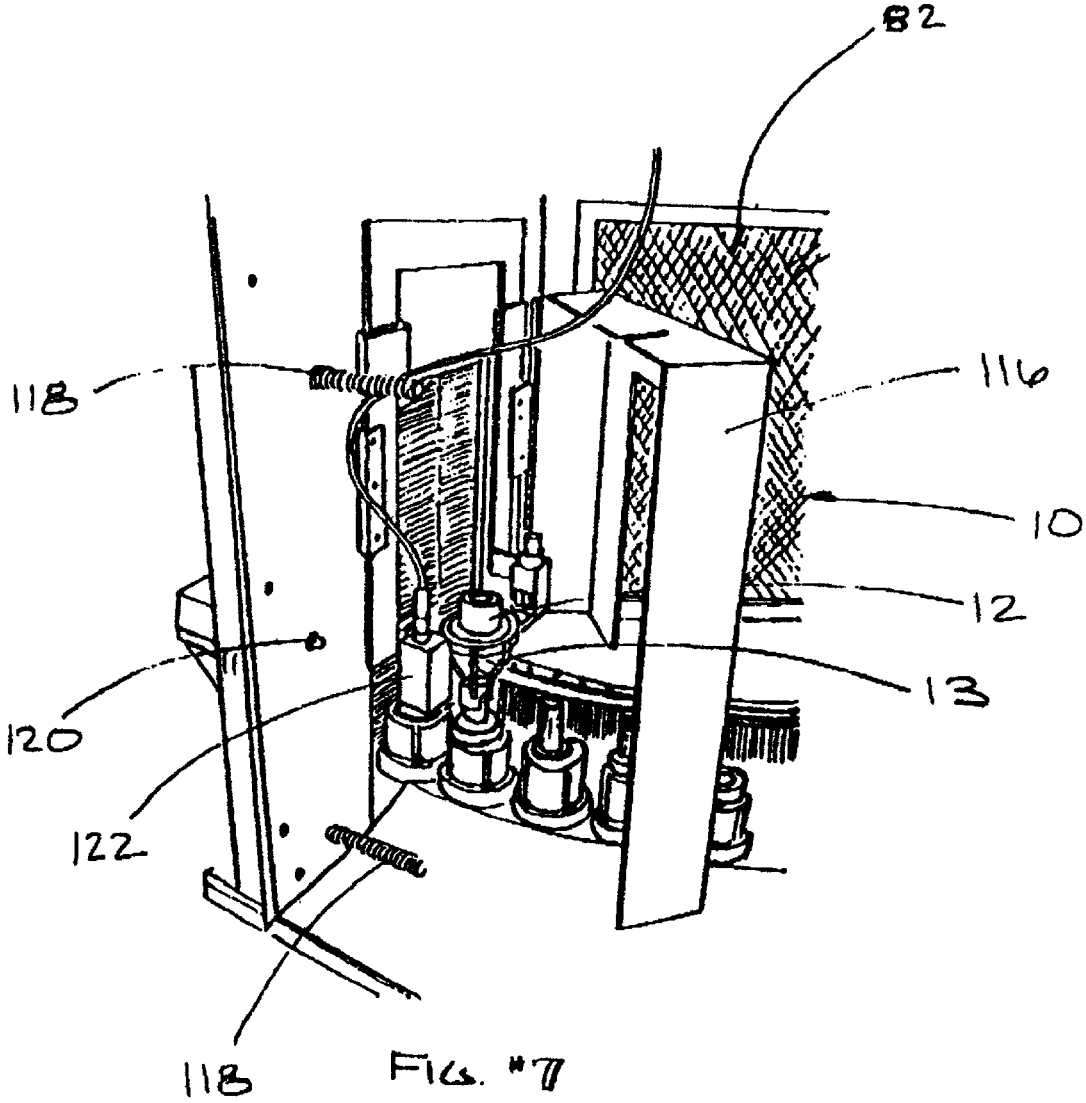
FIG. #7

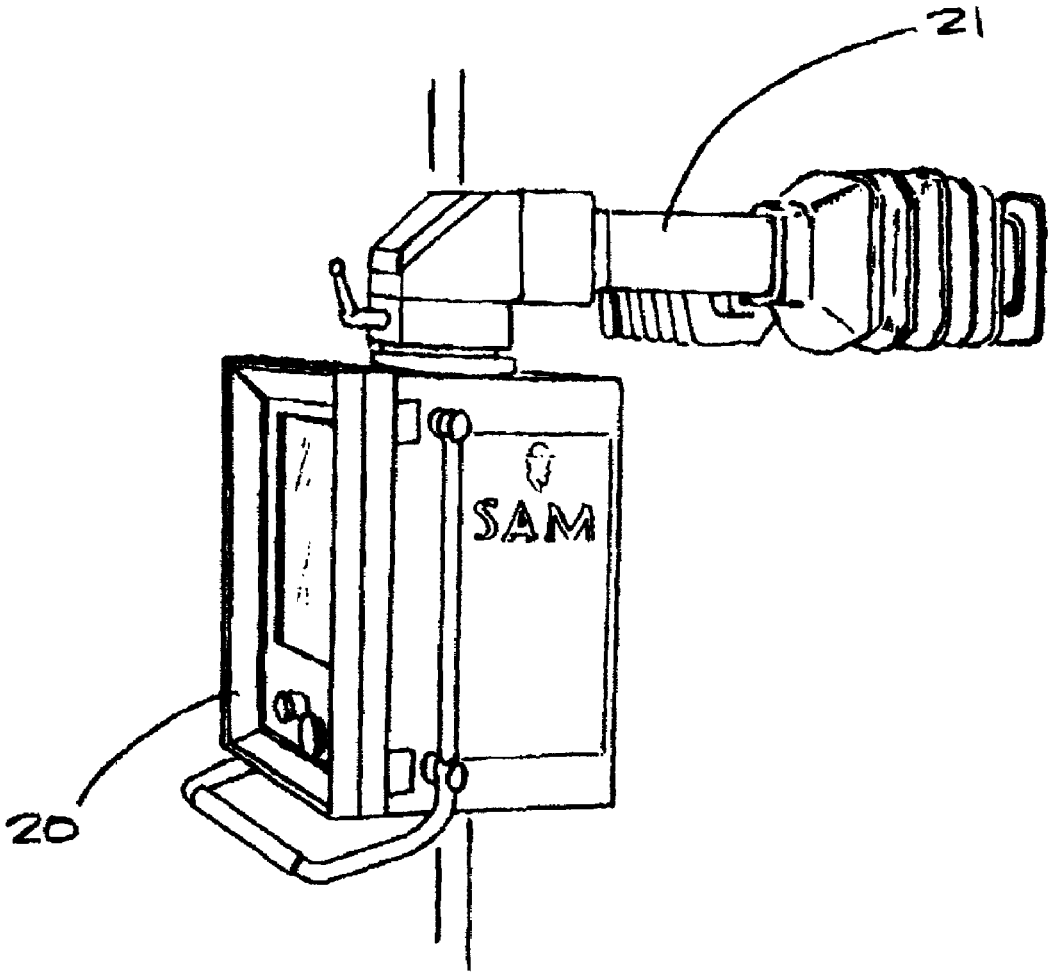
Fig # 9

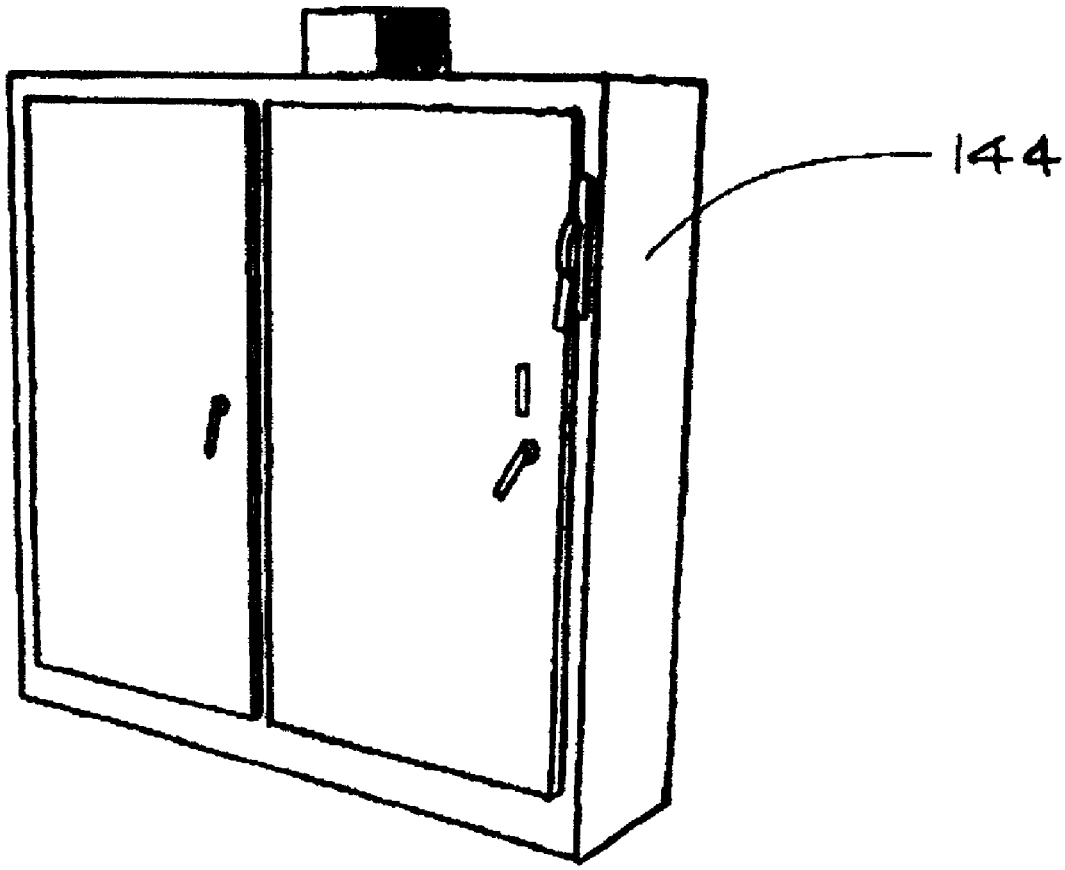
Fig #10

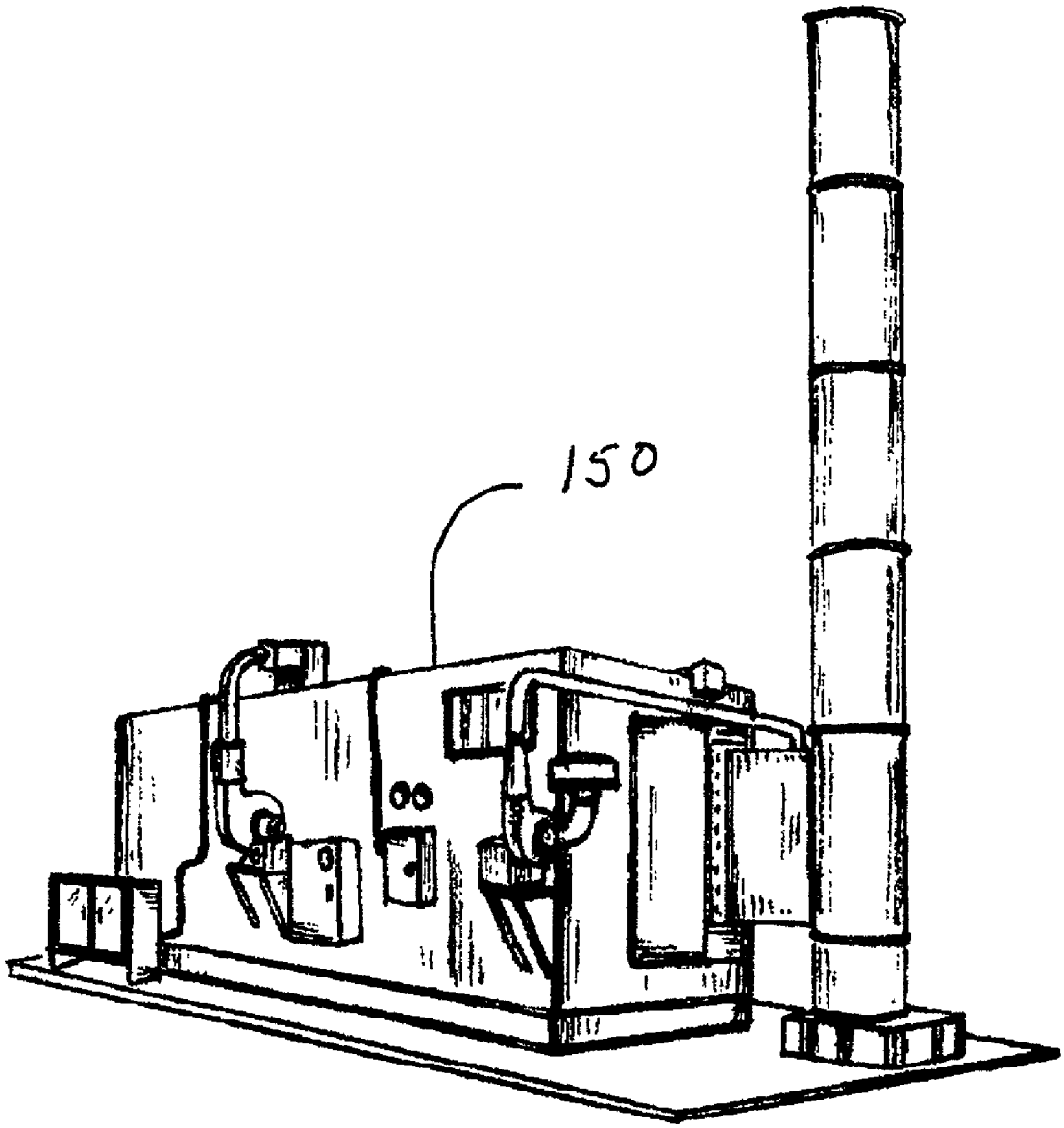
FIG #11

INDEXING SPRAY MACHINE

FIELD OF INVENTION

This invention relates to the field of spraying machine and more particularly to a station index spray machine.

BACKGROUND OF INVENTION

The United States government has placed strict standards on the making of spray machines. These standards are known as NEMA 7 compliance. These standards basically state that no electrical wiring or connections be exposed to the volatile fumes. Thus, one of the objectives of this invention is to create a spray booth which meets NEMA 7 compliance and no volatile fumes that make any contact with any wiring or connections. The feature that meets this objective is that the spray booth is sealed and all electrical components remain outside the spray booth. The inventor knows of no other indexing spray machine that meets NEMA 7 compliance. Another objective of this invention is that even though none of the electrical components are contained within the spray booth, the inventor is still able to spray a complete range of patterns on the work piece. The feature that accomplishes this is that the inventor extends actuator arms with sprayer attachments down from the top of the spray booth, thus leaving electrical components above the spray booth, but the sprayer arms are fully sealed by sleeves so that none of the volatiles seep out of the spray booth and into the area of the electrical components. These actuator arms move the sprayer up and down. The spindles holding the work piece also rotate and, thus, the spray gun can spray the workpiece in a complete assortment of different patterns.

Another feature much sought after in the art is to create an air capture system that efficiently removes the volatile fumes; however, sends only a small volume of air so that one is not sending large volumes of air through the oxidizer. The oxidizer burns the volatile fumes and by lowering the amount of air sent through the oxidizer, reduces the size of the oxidizer and the cost of operation. The feature used by the inventor to achieve this objective is he cascades the air to produce a small volume of air going to the oxidizer.

SUMMARY OF THE INVENTION

The machine is an index spraying machine. The machine has five different stations. The first station is the load/unload station. At this station, work pieces are unloaded after they have been sprayed and new work pieces to be sprayed are loaded on. New pieces then move into the pre-heat station tunnel. A third station is the spraying area. In this area, the work pieces are sprayed. After being sprayed, the work pieces move in the area where they are heated to flash off the volatile fumes. Then they move to the fifth work station where they are cooled and finally they move back into the load/unload station. The spraying area in this machine is sealed to meet NEMA 7 standards. The air capture system cascades the air, thus lowering the air volume that passes through the thermal oxidizer.

BRIEF DESCRIPTION OF THE DRAWINGS

FIG. 1 shows a front view of the load/unload station.

FIG. 2 is a view of the preheat zone air system.

FIG. 3 is a view of the spray booth with the doors closed and showing the upper workings of the actuator arms and the DC actuators.

FIG. 3A shows the spray booth with the doors removed showing the seal around the door area.

FIG. 4 shows the inside of the spray booth.

FIG. 5 shows the base frame.

FIG. 5A is a view of the drive mechanism of the table.

FIG. 6 shows the base frame enclosed with the table in place.

FIG. 7 is a view of the safety gate when open.

FIG. 9 is a view of the control panel.

FIG. 10 is a view of the electric panel enclosure.

FIG. 11 is a view of the thermal oxidizer.

DETAILED DESCRIPTION OF THE PREFERRED EMBODIMENT

Figure 8:
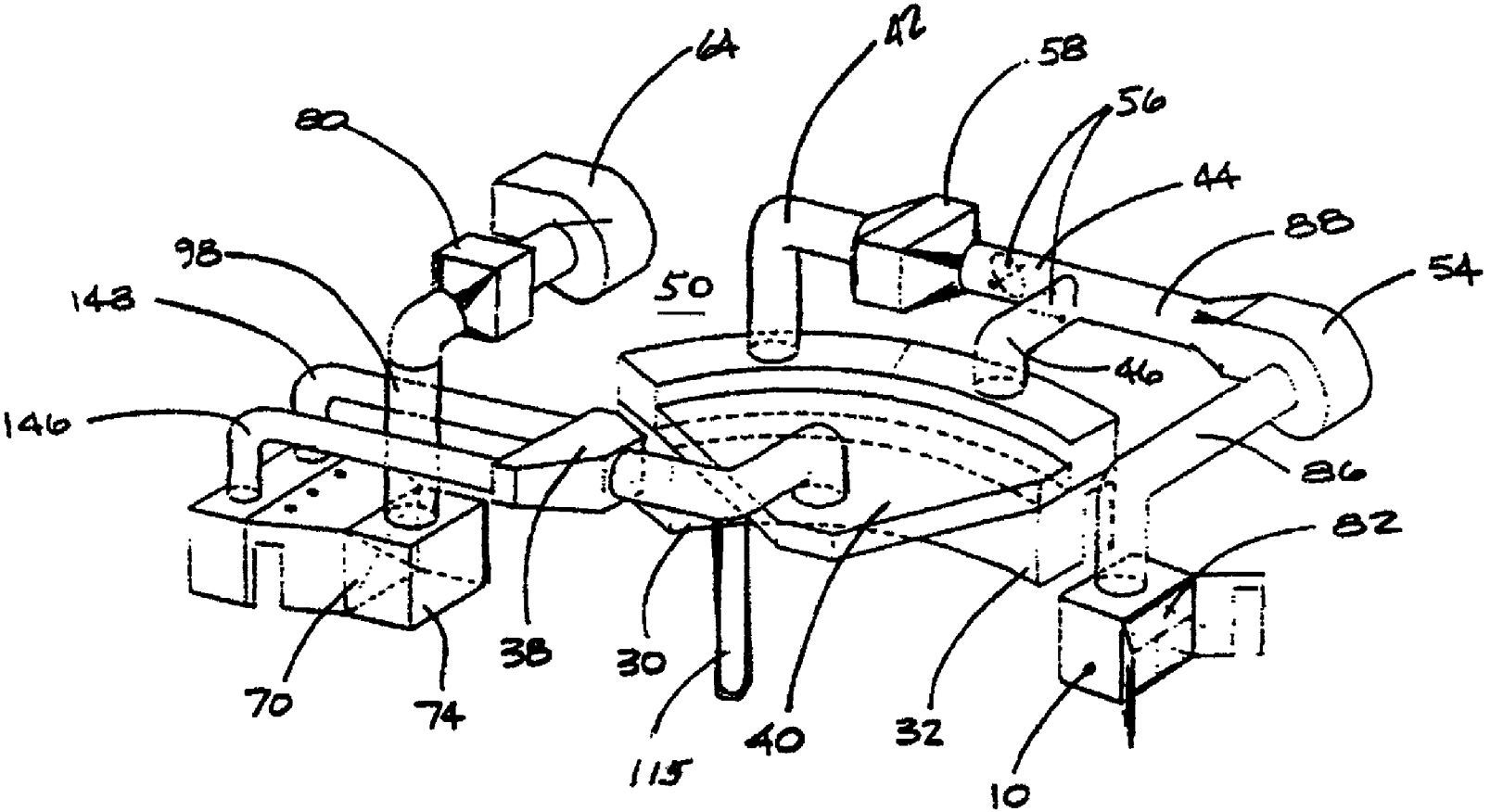
FIG. 8 is a view of the duct work of the air capture system.

The machine has basically five different stations. The load-unload station 10 is where the process begins. At this station, the work piece 12 is placed on a spindle 14. FIG. 1 shows the load-unload station 10. In the preferred embodiment, the work piece 12 is placed on a spindle 14 by an operator. However, the work pieces 12 could be placed on automatically. In the preferred embodiment, the machine indexes to the left and indexes two spindles 14 at a time.

The next station the machine indexes with the work piece 12 on the spindle 14 is the pre-heat zone tunnel 16. In the pre-heat zone tunnel 16, the spindle 14 begins to rotate and rotates through the rest of the process until it indexes into the load-unload station 10. The rotation speed of the spindle 14 is governed by an "AC" controlled variable speed and is adjustable according to product requirements. The operator at the load-unload station 10 can control this speed from his control panel 20. The same rotation speed is maintained throughout the whole process of indexing around the machine until the spindle 14 actually arrives back at the load-unload station 10. The spindle 14 does not spin at the load-unload station 10. The pre-heat zone tunnel 16, contains heated air that is continually re-circulated through a close-loop system shown in FIG. 2. This air can be re-circulated since there are no volatile chemicals generated in the pre heat zone tunnel 16. The rotating spindle 14 with the workpiece 12 remain in the heated environment through many index steps to bring the workpiece 12 to the desired temperature prior to their entering the spray booth zone 18. As the table 22 continues to index, the rotating spindles 14 and workpiece 12 emerge from the pre-heated zone tunnel 16 and enters the spray booth zone 18. There are two spray booths zones 18 and 24 shown in FIG. 3 in the preferred embodiment. However, this number can be more or less. As the workpiece 12 indexes from the pre-heat zone tunnel 16 into the spray booth zone 18, it moves through a set of nylon bristles 34 as shown in FIGS. 3 and 4. These nylon bristles 34 are there to prevent volatile fumes in the air of the spray booth zone 18 entering into the air of the pre-heat zone tunnel 16. Once the rotating spindles 14 and the workpiece 12 enter the first spray booth zone 18. The awaiting spray guns 26 shown in FIG. 4 will receive a signal to begin spraying the pre-heated workpiece 12 with the appropriate substance and in the predetermined pattern. Since the preferred embodiment has two spray booth zones 18 and 24, this substance would probably be some type of primer. However, any sprayable substance can be used. The spray booth handles two spindles 14 and workpieces 12 at a time, and there are two different spray guns 26, one for each spindle 14. Both spray guns 26 can spray the inner diameter and/or the outer diameter of the work piece 12. The spray booth zones 18 and 24 takes two spindles 14 at a time and has two spray guns 26 and, thus, probably will be spraying two workpieces 12 at a time. However, when the size of the workpiece 12 side exceeds the spindle 14 spacing, it will be necessary only to have one workpiece 12 placed on every other spindle 14. Thus, the first spray booth zone 18 would only spray one part at a time. The dc-controlled actuators 28 come down from above as shown in FIG. 3. The dc-controlled actuators 28 drive the spray guns 26 vertically at a pre-determined feed rate. The spray gun 26 and the de-controlled actuators 28 are designed so that the spray guns 26 can spray the inner or outer diameter of most workpieces 12 and can spray in almost any desired pattern upon said workpiece 12. With the next indexing, the workpiece 12 moves to the next set of spray guns 26 where another coating is placed upon this workpiece 12.

Upon completing the spraying of the workpiece 12 the workpiece 12 is indexed into the cure zone tunnel 30 of the machine. The completely sprayed workpiece 12 will remain in the cure zone tunnel 30 through several indexes. The cure zone tunnel 30 contains heated air that will be at a temperature to facilitate the "flash off" of solvent from the spray that was applied. This process is known as curing. In the preferred embodiment, the sprayed workpiece 12 continues to advance clockwise through it's indexing and through the cure zone tunnel 30. The workpiece 12 exits the cure zone tunnel 30 into the "cool" zone tunnel 32. At this point in the process, cooler "ambient" air will be blown directly on the sprayed and cured workpiece 12 to remove heat from the part for the handling by the operator at the load-unload station 10. The workpiece 12 will continue through the cool zone 32 until it is reduced to safe handling temperature and then it will index into the load-unload station 10 to be unloaded.

The air capture system 50 shown in FIG. 8 begins at the load-unload station 10 with the ambient air being pulled through the load-unload air diverter 82 shown in FIGS. 1 and 8 located directly in front of the operator. The air will pass through the intake filter 72 removing any dirt and debris prior to entering the overall air capture system 50. The air is pulled through with a first blower 54 and once the first blower 54 pulls the air through the intake filter 72, the air is exhausted from the discharge and is diverted in two directions. Dampers 56 are used to control the air flow. The air flow is directed in two directions. Some of the air flow is first diverted directly downward through a cool zone duct 46 into cooling zone tunnel 32 to cool the cured workpiece 12 prior to the load-unload station 10. The rest of the remaining air is directed further down stream towards heater duct 44 and into a heater 58. This heater 58 heats the air and then forces the air into the cure zone tunnel 30 through cure zone duct 42. This heated air is utilized in the flashing off process after the spraying of the volatiles.

The second portion of the air capture system 50 shown in FIG. 8 is a second blower 64 that pulls the air out of the cool zone 32 and the cure zone tunnels 30 through collector duct 40. The air is pulled out of the cool zone 32 and the cure zone tunnels 30, and this air is then split off through Y duct 38 to both sides of the spray booth zones 18 and 24. The air is put through two vertical air knives 66 and 68 shown in FIG. 4. One air knife 66 is located on the side of spray booth zone 18 near where the workpiece 12 enters the spray booth zone 18 from the pre-heat zone tunnel 16 and the other air knife 68 is located where the workpiece 12 leaves spray booth 24 to the cure zone tunnel 30. The air is directed into the spray booth zones 18 and 24 via the vertical air knife 66 and 68 to facilitate the air flow into the spray booth air diverters 70 and away from the spray guns 26. The spray booth zones 18 and 24 are where the majority of the volatile fumes will be generated. The air is then drawn up out of the spray booth zones 18 and 24 through spray booth air diverter 70 and into and through a one inch thick polyester filter 74 and into spray booth duct 98. The air with the volatile fumes is then pulled through filter box 80. There are two filters in filter box 80. The first polyester filter in the preferred embodiment is 2 inches thick, and the second filter, the safety filter is 12 inches thick. These filters capture most of the solids in the air. The filtered air is then drawn into a second blower 64 which is controlled by a variable frequency drive. It is possible to control both blower 54 and 64 by a variable frequency drive. Thus, the amount of air pumped by blower 64 can be controlled. The second blower 64 pushes the air into the thermal oxidizer 150 which burns the volatile substances in the air.

FIG. 5 and 5A shows the base frame 100 of the invention. In the center of the base frame 100 is the motor drive 102 for the table 22. Motor 102 drives the table 22 shown in FIG. 6. In the preferred embodiment, the drive motor 102 is a Ferguson drive and the drive motor 102 is an AC variable speed motor. The drive motor 102 has an air clutch 106 and brake 108. Base frame 100 is fully enclosed as shown in FIG. 6. FIG. 6 also shows the table 22 with spindles 14. Around the outer edge of the table 22 is a stainless steel brush 110. This stainless steel brush 110 keeps the volatiles from seeping around the edge of the table 22 and down into the area with the motor drive 102. To further ensure that there are no volatiles in this area, the air capture system 50 draws air from this area. A bottom center duct 115 from the air capture system 50 runs down through the opening 114 in the center of the table 22, and this duct exhausts the air from underneath the table 22 and within the inner area of the base frame 100.

FIG. 1 shows the load/unload station 10. The load/unload station 10 has two ways in which the operator can, in the case of emergency, stop the indexing of the machine. First is the safety gate 116. This safety gate 116 surrounds the entrance to the pre-heat zone tunnel 16.

FIG. 7 shows the safety gate 116 partially removed. In this figure, you can see how this safety gate 116 works. An operator who wishes to stop the indexing of the machine, presses on the safety gate 116. Beneath the safety gate 116 are springs 118 which hold it away from the entrance to the pre-heat zone tunnel 16. There is also a stop pin 120 so that when an operator presses on the safety gate 116, it compresses the springs 118 and makes contact with the stop pin 120 which stops the indexing of the machine. Also on the inside of the safety gate 116 is a workpiece sensor 122. This sensor 122 has an electronic eye and checks to ensure that there is a workpiece 12 on the spindle 14. If there is no workpiece 12 on the spindle 14, the sensor 122 notifies the computer, and the computer does not activate the spray guns 26 for the spindle 14 without a workpiece 12, and thus, no paint will be used.

Another safety device is the wire 124 shown in FIG. 1 that runs at the top of the load/unload station 10. If this wire 124 is pulled by the operator, the indexing of the machine stops. The wire 124 is attached to a sensor which notifies the electronic system to stop the indexing of the machine. Also, at the back of the load/unload booth is an air intake 82, the main air intake, for the capture system 50. The air is pulled through this air intake 82 into the air capture system 50. There is a intake filter 72 on this air intake 82 to ensure that dirt and other objects do not contaminate the air going into the air capture system 50.

FIG. 3 shows the spray booth zones 18 and 24. On the outside of the spray booth zones 18 and 24 are two doors 128 that allows one to enter into the spray booth zones 18 and 24 and set up intrinsically safe different sensing devices within the booth to sense how well the spraying occurs or the temperature of the workpiece 12. Thus, an individual could set up pyrometers within the spray booth zones 18 and 24 or other sensing devices. Each spray booth zones 18 and 24 has two spray guns 26 and two spindles 14. In other words, the machine has four spray guns 26. The doors 128 on the spray booth zones 18 and 24 are a rubber seal 130 around the circumference of the opening to the spray booth zones 18 and 24 which is shown in FIG. 3A and are pressure fastened so that no volatiles will escape out of the spray booth zones 18 and 24 when the doors 128 are closed.

FIG. 4 shows the inside of the spray booth zones 18 and 24. FIG. 4 shows that on the sides of the spray booth zones 18 and 24 are air knives 66 and 68. This is where the air from the air capture system 50 enters the spray booth zones 18 and 24. The air from the air capture system 50 enters through the air knives 66 and 68. The air flow is diverted by these air knives 66 and 68 away from the spray guns 26 so that it does not affect the spraying of the paint. The air is withdrawn from the spray booth zones 18 and 24 through the air diverters 70 and through a one inch thick polyester filter and into a spray booth duct 98 in the back of the spray booth zones 18 and 24. The air is pulled through a Dynacom filter box 80 in which the first filter is two inches thick and the second filter is twelve inches thick.

FIG. 3 shows the area above the spray booths 18 and 24. In this area is the dc controlled actuators 28 that move the spray guns 26 shown in FIG. 4. A floor 138 separates the dc controlled actuators 28 from the spray booths 18 and 24. Only the control rods 140 extend down from the dc controlled actuators 28 through the floor 138 and into the spray booths 18 and 24. The spray guns 26 are attached to the control rods 140. As we can see from FIG. 3, the control rods 140 extend through the floor 138; however, the control rods 140 are covered by sleeves 142 that attach to the bottom of a floor 138 and the control rod 140 and completely seal the spray booth zones 18 and 24 so no volatiles can escape through the openings for the control rods 140. The sleeves 142 are expandable so that the control rods 140 can move up and down and can move the spray gun 26 vertically. In the preferred embodiment, the dc controlled actuators 28 from the above drive the spray guns 26 vertically at a predetermined rate.

At the load/unload station 10 is a control panel 20 shown in FIG. 9. From the control panel 20, the operator can control all aspects of the machine. He can control the speed at which the machine indexes, the temperature of pre-heat zone tunnel 16 and the cure zone tunnel 30, the rate at which spray guns 26 dispense their liquid, the vertical movement of the spray guns 26, rate at which the spindles rotate 14, and all the other aspects of the machine. Also, the system can be designed so that for a given part number, the machine will automatically know the spray pattern for the spray guns 26.

FIG. 10 shows the electric panel enclosure 144. Within this enclosure is contained all the controls for the electrical system including the micro processor that controls the whole system.

FIGS. 2 and 8 show the duct work on the top of the machine. This duct work contains the blowers 54, 64, 152, and duct work of the air capture system 50. The duct work of the air capture system 50 begins at the load/unload station 10 where the outside air is being pulled through an air intake 82 located directly in front of the operator as shown in FIG. 1. The air passes through the intake filter 72 which removes any dirt and debris prior to entering the overall air capture system 50. The air is pulled up from load/unload station 10 air intake 82 through first duct 86. The air is pulled by the first blower 54. The first blower 54 feeds the air out into blower duct 88. Along this blower duct is damper 56. Dampers 56 controls the air flow into cool zone tunnel duct 46 and cure heater 58. Air diverted into cool zone tunnel duct 46 flows into the cool zone tunnel 32. The air diverted into heater 58 flows out of heater 58 into cure zone tunnel duct 42 and downward into the curing zone tunnel 30. The air from both the curing zone tunnel 30 and the cooling zone tunnel 32, then flows up through exhaust duct 40 into a Y fitting 38. The air is then divided along the right and left channel ducts 146 and 148. The air in right channel duct 146 flows into air knife 66 in the spray booth zones 18 and 24, and the air from left channel duct 148 flows through air knife 68 into spray booth 24. The air is pulled out of spray booth zones 18 and 24 through the spray booth exhaust duct 98 by blower 64. Actually the air is pulled out of spray booth zones 18 and 24 through spray booth exhaust duct 98 and filter box 80 by blower 64. The air is exhaled out of blower 64 to the thermal oxidizer 150 which incinerates the volatile fumes.

FIG. 2 shows the preheat zone air system. This system contains preheat zone blower 152 and preheat zone heater 154. The pre heat zone blower 152 intakes the air from the preheat zone tunnel 16 through preheat zone heater 154. The air is heated by the preheat zone heater 154 and returned to the preheat zone tunnel 16 by the preheat zone blower 152. Thus this air is continually recirculated which lower the energy cost of heating this air. The preheat zone tunnel contains no volatile fumes and thus it is not necessary to have this air flow through the air capture system 50 or the thermal oxidizer 150.

Changes and modifications in the specifically described embodiments can be carried out without departing from the scope of the invention which is intended to be limited only by the scope of the appending claims

The invention claimed is:

1. A machine for spraying a workpiece comprising:

a. a housing; and b. a means for indexing the workpiece from one station to another within the housing; and c. a means for attaching the work piece to the means for moving the workpiece; and, d. a load station at which the work piece is loaded upon the means for attaching the work piece to the means for indexing the workpiece; and, e. a spray station at which the work piece is sprayed and the spray station is comprised of a booth with walls that is enclosed and no air can get into the spray station except from the air capture system and none of the volatile fumes from the spraying can get out of the spray station except through the air capture system; and, f. a cure station at which the work piece is cured; and, g. a cooling station where the workpiece is cooled; and, h. an unload station at which the work piece is unloaded after the work piece has moved through the other stations; and, i. said means for moving the workpiece moves said workpiece from the input station to the spray station and then to the curing station and then to the cooling station, and then to the unload station; and, j. an air capture system that is designed to capture air containing volatile fumes from the spraying the workpiece in the spray station and the volatile fumes from curing the workpiece and burn them in a thermal oxidizer and said air capture system brings air from outside the machine, filters this air brought into the air capture system and moves the air over the workpiece in the cooling station to cool the work piece, and brings air from outside the machine, filters this air brought into the air capture system and heats the air and moves the air over the workpiece in the cure station to flash off the volatile fumes then combines the air discharged from the cooling station and the cure station and moves this air from the cure station and the cooling station to the spray station and then to the thermal oxidizer.

2. A machine for spraying a workpiece as in claim 1 further comprising:

a. a spray gun within the spray station and said spray gun sprays the workpiece; and, b. a means for moving the spray gun in which all electrical components lie outside the spray station.

3. A machine for spraying a workpiece as in claim 2 further comprising;

a. the means for moving the spray gun comprises:

1. an actuator that lies outside the spray booth; and, 2. a bar attached to the actuator and the spray gun and, the bar extends into the booth through an aperture in a wall of the booth, and a sleeve attached to the bar and the wall of the booth such that the bar is able to move and the sleeve fully seals the booth and no volatile fumes can escape the booth except through the air capture system.

4. A machine for spraying a workpiece as in claim 1 wherein:

a. the means for moving the workpiece from one station to the next is an indexing table.

5. A machine for spraying a workpiece as in claim 4 wherein:

a. the means for attaching the work piece to the means to move the workpiece is a spindle and the spindle can rotate thus rotating the workpiece.

6. A machine for spraying a workpiece as in claim 5 further comprising:

a. an electronic control system the controls the rate at which the spindle rotates and the rate at which the actuator moves the spray gun and the rate at which the spray gun sprays thus controlling the pattern sprayed on the workpiece.

7. A machine for spraying a workpiece as in claim 4 further comprising:

a. a seal between the indexing table outer circumference and the housing which does not allow the volatile fumes to pass from the spray station or the cure station to the area underneath the table.

8. A machine for spraying a workpiece as in claim 1 wherein:

a. the spray booth contains no electrical components.

9. A machine for spraying a workpiece as in claim 1 further comprising:

a. a preheat station where the workpiece is heated between the load station and the spraying station.

10. A machine for spraying a workpiece as in claim 9 further comprising:

a. when the workpiece moves into the spraying station from the preheat station, the workpiece moves through an opening filled with a set of bristles designed to keep the volatile fumes from escaping the spray station through the opening.

11. A machine for spraying a workpiece comprising:

a. a housing; and b. a means to move the workpiece from one station to another within the housing; and c. a means for attaching the work piece to the means to move the workpiece; and, d. a load station at which the work piece is loaded upon the means for attaching the work piece to the means to move the workpiece; and, e. a spray station at which the work piece is sprayed and said spray station contains no electrical parts; and, f. a cure station at which the work piece is cured; and, g. an unload station at which the work piece is unloaded after the work piece has moved through the other stations; and, h. said means for moving the workpiece moves said workpiece from the input station to the spraying station and then to the curing station and ten to the unload station; and, i. an air capture system that is designed to capture air containing volatile fumes from the spraying the workpiece in the spray station and the volatile fumes from curing the workpiece and burn them in a thermal oxidizer and said air capture system moves the air from the cure station and spray station containing the volatile fumes to the thermal oxidizer.

12. A machine for spraying a workpiece as in claim 11 further comprising:

a. a spray gun within the spray station and said spray gun sprays the workpiece; and, b. a means for moving the spray gun in which all electrical components lie outside the spray station.

13. A machine for spraying a workpiece as in claim 12 further comprising:

a. the means for moving the spray gun comprises:

1. an actuator that lies outside the spray booth; and, 2. a bar attached to the spray gun and, the bar extends into the booth through an aperture in a wall of the booth, and a sleeve attached to the bar and the wall of the booth such that the bar is able to move and the sleeve fully seals the booth and no volatile fumes can escape the booth except through the air capture system.

* * * * *